United States Patent [19]
Kaspersma et al.
[11] 4,317,687
[45] Mar. 2, 1982

[54] CARBURIZING PROCESS UTILIZING ATMOSPHERES GENERATED FROM NITROGEN-ETHANOL BASED MIXTURES

[75] Inventors: Jelle H. Kaspersma, Coopersburg; Robert H. Shay, Kutztown, both of Pa.

[73] Assignee: Air Products and Chemicals, Inc., Allentown, Pa.

[21] Appl. No.: 148,854

[22] Filed: May 12, 1980

[51] Int. Cl.[3] ..... C21D 1/48
[52] U.S. Cl. ..... 148/16.5; 148/16.6; 148/20.3
[58] Field of Search ..... 148/16, 16.5, 16.6, 148/20.3

[56] References Cited

U.S. PATENT DOCUMENTS

| | | | |
|---|---|---|---|
| 2,673,821 | 3/1954 | Stutzman | 148/16.5 |
| 3,201,290 | 8/1965 | Wyss | 148/16 |
| 4,154,232 | 3/1979 | Solomon | 148/16.5 |
| 4,154,629 | 5/1979 | Asai et al. | 148/16.5 |

FOREIGN PATENT DOCUMENTS 816051 7/1959 United Kingdom .

OTHER PUBLICATIONS

Traitement Thermique, 62 (1971), 35–45, pub. Traitement Thermique, 254 Rue de Vaugirad, 75740, Paris.

*Primary Examiner*—L. Dewayne Rutledge
*Assistant Examiner*—John P. Sheehan
*Attorney, Agent, or Firm*—James C. Simmons; E. Eugene Innis

[57] ABSTRACT

A process for carburizing ferrous metal articles in a furnace under an atmosphere derived from an input of nitrogen and ethanol injected into the furnace during the entire cycle. Carburization is controlled in a first embodiment by the control of ethanol and nitrogen mixture and water vapor content of the mixture as well as total flow through the furnace and in a second embodiment by controlling the nitrogen-ethanol mixture to which is added water and an enriching or carburizing agent.

6 Claims, No Drawings

CARBURIZING PROCESS UTILIZING ATMOSPHERES GENERATED FROM NITROGEN-ETHANOL BASED MIXTURES

TECHNICAL FIELD

This invention relates to a process for carburizing ferrous metals and in particular to a process wherein a furnace atmosphere is created by injecting nitrogen and ethanol separately or as a mixture into a furnace. Carbon potential of the furnace atmosphere can be established and maintained by control of the total flow of input components during the carburizing cycle as well as control of and/or addition of water in the input mixture and the addition of enriching or carburizing agents in the input composition.

BACKGROUND OF THE PRIOR ART

Carburization is the conventional process for case hardening of ferrous metals, e.g. steel. In gas carburizing, the steel is exposed to an atmosphere which contains components capable of transferring carbon to the surface of the metal from which it diffuses into the body of the part. After an appropriate amount of carbon has been transferred, the steel is removed from the furnace and rapidly quenched, whereupon those regions in which the carbon level has been raised become hard and wear-resistant.

A variety of atmospheres have been employed, but they share a number of features in common. They must not react with the steel to form oxides or other undesirable compounds. This requirement precludes the presence of oxygen, and more than small amounts of water or carbon dioxide. Second, they must contain a substance which can serve as a carbon donor to the surface of the steel. Most commonly this is carbon monoxide, but occasionally hydrocarbons or oxygenated organic materials are employed. Third, the atmosphere must activate the surface of the steel so that reaction with the carbon donor proceeds at an acceptable rate. Hydrogen is highly effective as an activator, and is invariably present in practical carburizing atmospheres. Atmospheres derived from a variety of sources have been employed, but the most commonly used one is the so-called endothermic gas produced by partial combustion of natural gas in air. It consists essentially of 40% nitrogen, 40% hydrogen and 20% carbon monoxide. It is usually necessary to add a small amount of another constituent, commonly natural gas, to raise its carbon potential.

The use of endothermic atmospheres has a number of disadvantages. An expensive and elaborate endothermic gas (endogas) generator which requires continuing maintenance and attention of an operator is needed. Furthermore, the gas generator cannot be turned on and off at will; once it is running it is necessary to keep it in operation even though the demand for the atmosphere may vary from a maximum load to zero. The endogas, and the natural gas required to produce it, are wasted during periods of low demand. Further, natural gas is not constant in composition, containing varying amounts of ethane, propane and higher hydrocarbons in addition to the main constituent, methane. Variability in natural gas composition causes substantial changes in the endogas produced, and gives rise to problems of control. Finally, burning increasingly scarce and expensive natural gas to produce an atmosphere is inherently wasteful of energy.

A more recent development in the production of carburizing atmospheres involves the use of inexpensive by-product nitrogen which is introduced into the carburizing furnace along with methanol. The latter is thermally decomposed to produce a mixture of hydrogen and carbon monoxide, which serves as a carburizing atmosphere. It is usually necessary to add another constituent, frequently natural gas, to raise the carbon potential of such atmospheres. However methanol is commonly produced from natural gas or petroleum, and as fossil fuel becomes scarcer and more expensive, this approach again represents a waste of valuable energy.

There have been attempts to use ethanol, which may be produced from renewable agricultural products, for the generation of atmospheres for carburization. For example, U.S. Pat. No. 2,673,821 describes the generation of a furnace atmosphere from a mixture of ethanol and water. Control of carbon potential and prevention of massive carbon deposition (sooting) is achieved by addition of water. However, blue-black surfaces are reported in the literature for the hardened pieces indicating that incipient sooting took place. Further, since no constituent other than ethanol containing a relatively small amount of water is employed for generation of the atmosphere, excessive cost and wastage are experienced.

British Pat. No. 816,051 describes in general terms a process whereby nitrogen is saturated with a volatile organic substance and passed into a heat-treating furnace to generate an atmosphere suitable for carburization. Although no details are given, it is stated that ethanol may be used in this process. However, in Traitement Thermique, 62 (1971) 35–45 published by Traitement Thermique, 254 Rue de Vaugirad 75740 Paris, France, the authors state that only methanol and acetone are suitable in this process. Ethanol is reported to produce gum in the exit port of the furnace and to cause only weak and irregular carburization.

BRIEF SUMMARY OF INVENTION

Ferrous metal articles can be effectively carburized utilizing nitrogen and ethanol mixtures directed into a carburizing furnace simultaneously as discrete streams or as a mixture. In a first embodiment of the invention carburization is effected by controlling the amount of water in the ethanol and the ratio of ethanol to nitrogen, as well as the total flow of the components through the furnace. A second embodiment of the invention resides in a process utilizing a nitrogen-ethanol base mixture supplemented by the addition of controlled amounts of water and a hydrocarbon enriching or carburizing agent. Either embodiment includes control of the carbon potential of the furnace atmosphere by controlling input composition and total flow through the furnace.

DETAILED DESCRIPTION OF INVENTION

It has been found that steel may be successfully carburized by heating it in a furnace into which a mixture of nitrogen and ethanol is passed. The carbon potential of the atmosphere is continuously determined by a suitable means such as an iron wire sensor. Alternatively, the atmosphere may be continuously analyzed for the concentrations of carbon monoxide and carbon dioxide by a gas chromatograph, or by infrared analysis. The carbon potential can be calculated from these gas analyses.

The flow of ethanol is varied in order to maintain the desired carbon potential. An increase in ethanol flow rate results in an increase in carbon potential while a decrease in carbon potential may be achieved by reducing the ethanol flow rate. Since the rate at which carbon is absorbed by the steel declines as its carbon content increases, it is usually necessary to begin the operation with a certain flow rate and decrease the rate as the run progresses.

The ethanol may be anhydrous, or it may contain water. Commercial 95% (190 proof) ethanol is a convenient product for use in this process, but water levels of up to about 15% by volume may be accommodated. It may be advantageous in cases where a relatively low carbon potential is desired to use ethanol containing these greater quantities of water. Water lowers the carbon potential at a given ethanol flow rate.

The ethanol may be introduced into the furnace either by vaporizing it into the nitrogen stream or by spraying it through a nozzle directly into the furnace along with the nitrogen. The quantity of ethanol which is employed ranges from as low as about 1% to as high as about 50% with the usual preferred range being about 10 to 20% depending on temperature, desired carbon potential and the surface area of the load of steel parts to be carburized. The total flow rate through the furnace may range from as low as 2 to as high as 6 standard volume changes per hour with a usual preferred range being from about 3 to about 4 standard volume changes per hour. At higher flow rates incomplete decomposition of ethanol may occur with resultant relatively low carburizing efficiency. Much lower flow rates may give rise to problems in leaky furnaces where air will reduce carbon potentials excessively.

This first embodiment of the invention is best understood by reference to Example 1 and Table I wherein there is set out a series of tests conducted to illustrate this part of the invention.

EXAMPLE 1

For the tests a 7.5 cubic foot batch-type furnace heated with alloy radiant tubes and provided with a circulating fan was used to carburize a load consisting of American Iron and Steel Institute (AISI) type 1010 steel rivets. The rivets were placed in the furnace which was then closed and fed with nitrogen and ethanol at the flow rates indicated in Table I. The furnace was brought to the indicated operating temperature in 30 minutes and then was held for 2½ hours at temperature.

TABLE I

| Run No. | Fce. Temp. °F. | Fce. Load Wt. | Input Composition[1] % by Volume $N_2$ | EtOH | $H_2O$ | Furnace Comp. % by Volume $H_2$ | CH4 | CO |
|---|---|---|---|---|---|---|---|---|
| 1 | 1550 (843° C.) | 15 lb | 91.4 (25) | 7.3 (2.0) | 1.3 (0.34) | 16.6 | 1.0 | 9.15 |
| 2 | 1550 (843° C.) | 15 lb | 88.7 (25) | 9.6 (2.7) | 1.7 (0.47) | 24.5 | 1.8 | 12.00 |
| 3 | 1700 (927° C.) | 15 lb | 88.7 (25) | 9.6 (2.7) | 1.7 (0.47) | 22.0 | 0.5 | 11.65 |
| 4 | 1700 (927° C.) | 15 lb | 82.8 (25) | 14.7 (4.45) | 2.5 (0.76) | 30.4 | 1.0 | 13.90 |
| 5 | 1700 (927° C.) | 60 lb | 77.8 (25) | 18.9 (6.1) | 3.3 (1.05) | 35.0 | 1.4 | 15.71 |

| Run No. | Furnace Comp. % by Volume $CO_2$ | D. P. °F.[2] | $Pco^2/Pco_2$ | Case % C. | Depth Inches | Hardness, Rc |
|---|---|---|---|---|---|---|
| 1 | 0.068 | +10 | 12.3 | 0.67 | 0.014 | 51.0 |
| | 0.058 | +5 | 14.4 | 0.76 | | |
| 2 | 0.087 | +18 | 16.6 | 0.87 | 0.018 | 55.0 |
| | 0.087 | +18 | 16.6 | 0.85 | | |
| | 0.087 | +18 | 16.6 | 0.88 | | |
| 3 | 0.041 | −4 | 33.4 | 0.71 | 0.024 | 55.0 |
| | 0.031 | −4 | 44.1 | 0.90 | | |
| | 0.027 | −4 | 49.6 | 1.01 | | |
| 4 | 0.034 | +5 | 56.9 | 1.20 | 0.030 | 60.0 |
| | 0.034 | +5 | 56.3 | 1.17 | | |
| | 0.034 | +5 | 56.9 | 1.08 | | |
| 5 | 0.048 | +10 | 51.5 | 1.16 | 0.028 | 47.0 |
| | 0.046 | +10 | 53.4 | 1.13 | | |
| | 0.045 | +10 | 55.2 | 1.15 | | |

[1]Flow rate in Standard Cubic feet per hour shown ( ).
[2]Dew Point

Composition of the furnace atmosphere is indicated, as is the percentage carbon in a shimstock test piece and case depth and hardness attained in the rivets. The parts were clean and without soot deposit. The increased carbon potential attained with increasing ethanol flow rate is demonstrated in runs 1–4. The larger load in run 5 required a greater ethanol flow rate to maintain the same carbon potential as that in run 4.

From the foregoing it has been demonstrated that ferrous metal parts can be effectively carburized utilizing an ethanol-nitrogen mixture injected into a furnace by controlling the amount of water in the ethanol and the total flow of ethanol and nitrogen through the furnace.

In another embodiment of the invention a suitable base furnace atmosphere similar in composition to that derived from nitrogen and methanol can be produced by passing into a furnace a stream of nitrogen to which has been added ethanol and water in a 1 to 1 molar ratio. The mixture of ethanol and water is obtained by adding 0.31 liters of water to every liter of anhydrous (100%) ethanol, or 0.265 liters of water to every liter of commercial 95% (190 proof) ethanol. The final percentage of water in the liquid mixture is approximately 24% by volume. At furnace temperatures of about 1500° to about 1900° F. (816° to 1038° C.) the ethanol and water react to produce a gas containing carbon monoxide and hydrogen in an approximately 1 to 2 ratio, along with small quantities of methane, carbon dioxide and water. The resulting furnace atmosphere can be used for neutral hardening of low carbon steels. If it is desired to cause carburization, the carbon potential of the atmosphere may be raised by addition of an enriching gas such as natural gas containing substantially methane, propane, butane, ethane and mixtures thereof. The carbon potential of the atmosphere is continuously determined by a suitable means such as an iron wire sensor. Alternatively, the atmosphere may be continuously analyzed for the concentrations of carbon monoxide and carbon dioxide by means of a gas chromatograph or by infrared analysis. The carbon potential can be calculated from these gas analyses, and adjusted upwards or downwards by changing the rate of addition of enriching gas. An increase in the quantity of enriching gas causes a rise in carbon potential while a lowering of carbon potential results when the flow of enriching gas is diminshed. Control of enriching gas flow can be manual, or can be achieved automatically using well known and commonly available equipment.

The following examples illustrate the manner of practicing this invention.

EXAMPLE 2

A 7.5 cu. ft. batch type furnace provided with radiant tube heaters and a circulating fan was employed to demonstrate the generation of typical furnace atmospheres and to show that these could be effectively used for the carburization of steel parts. In the first series of experiments the furnace was operated without a load while the amount of propane added was varied over a substantial range. The ethanol and water were sprayed separately as liquids into the furnace through the port which was also employed for the introduction of gaseous nitrogen. Propane was introduced into the nitrogen stream prior to entry into the furnace. A sample of furnace atmosphere was continuously withdrawn and was analyzed at frequent intervals by means of a gas chromatograph. A strip of steel shimstock 0.005 cm (0.002 in.) in thickness was suspended in the furnace to provide a measure of carbon potential. At termination of the run the shimstock was rapidly withdrawn, cooled and analyzed for carbon.

The results are shown in Table II. The column headed Percent C Theoretical (Theor.) is the theoretical carbon potential calculated from the individual analyses for carbon dioxide and carbon monoxide. The column headed Percent C Shim is the actual analysis of the Shimstock sample carbon. It is evident that calculated and measured values of carbon potential are in excellent agreement.

TABLE II

| Fce. Temp °F. | Input Flow SCFH(1) $N_2$ | $C_2H_5OH$ | $H_2O$ | $C_3H_8$ | Furnace Analysis $H_2$(2) | $CH_4$(2) |
|---|---|---|---|---|---|---|
| 1550 (843° C.) | 20 (77.0) | 3 (11.5) | 3 (11.5) | — | 30.59 | 1.46 |
| 1550 (843° C.) | 20 (74.8) | 3 (11.2) | 3 (11.2) | 0.75 (2.8) | 32.43 | 1.61 |
| 1550 (843° C.) | 20 (73.7) | 3 (11.0) | 3 (11.0) | 1.15 (4.3) | 34.04 | 1.47 |
| 1700 (927° C.) | 20 (77.0) | 3 (11.5) | 3 (11.5) | — | 28.88 | 0.94 |
| 1700 (927° C.) | 20 (74.6) | 3 (11.2) | 3 (11.2) | 0.75 (2.8) | 33.51 | 0.41 |
| 1700 (927° C.) | 20 (73.7) | 3 (11.0) | 3 (11.0) | 1.15 (4.3) | 35.36 | 0.81 |

| Fce. Temp °F. | Furnace Analysis CO(2) | $CO_2$(2) | D.P. °F.(3) | $P_{CO}^2/P_{CO_2}$ | % C. Theor. | % C. Shim |
|---|---|---|---|---|---|---|
| 1550 (843° C.) | 14.94 | 1.08 | +34 | 2.1 | 0.18 | 0.11 |
| 1550 (843° C.) | 15.84 | 0.21 | +34 | 11.9 | 0.87 | 0.67 |
| 1550 (843° C.) | 15.43 | 0.19 | −0 | 12.5 | 0.92 | 0.94 |
| 1700 (927° C.) | 14.11 | 0.87 | +30 | 2.3 | 0.08 | 0.09 |
| 1700 (927° C.) | 17.12 | 0.10 | −8 | 29.3 | 0.81 | 0.77 |
| 1700 (927° C.) | 17.86 | 0.08 | −18 | 40.0 | 1.05 | 1.02 |

(1)( ) Composition in % by volume
(2)Percent by volume
(3)Dew Point

EXAMPLE 3

The furnace and procedure described in Example 2 were employed for the carburization of two 15 lb. charges of AISI type 1010 rivets. The input flows and furnace gas analyses are shown in the following Table III.

TABLE III

| Run No. | Fce. Temp °F. | Input Flow SCFH(1) $N_2$ | $C_2H_5OH$ | $H_2O$ | $C_3H_8$ | Furnace Analysis $H_2$(2) | $CH_4$(2) |
|---|---|---|---|---|---|---|---|
| 1 | 1700 (927° C.) | 20 (73.7) | 3 (11.9) | 3 (11.0) | 1.15 (4.3) | 36.93 | 1.08 |
| 2 | 1550 (843° C.) | 20 (78.7) | 3 (11.0) | 3 (11.0) | 1.15 (4.3) | 33.18 | 4.48 |

| Run No. | Furnace Analysis CO(2) | $CO_2$(2) | D.P. °F.(3) | $P_{CO}^2/P_{CO_2}$ | % C. Theor. | % C. Shim |
|---|---|---|---|---|---|---|
| 1 | 18.12 | 0.008 | −15 | 37.3 | 0.99 | 1.12 |
| 2 | 17.43 | 0.25 | +34 | 12.2 | 0.90 | 0.85 |

(1)( ) Composition in % by volume
(2)Percent by volume
(3)Dew Point

The rivets were withdrawn from the furnace after 2½ hours at temperature in each run, cooled and subjected to a metallographic examination to determine total and effective case depth. The results of these determinations are shown in Table IV.

TABLE IV

| Run No. | Temp. °F. | Case Depth (inches) Total | Effective |
|---|---|---|---|
| 1 | 1700 (927° C.) | 0.035 | 0.017 |
| 2 | 1550 (843° C.) | 0.016 | 0.007 |

The results are entirely satisfactory and in the case of run 2 at 1700° F. are virtually identical to those obtained at the same temperature with an atmosphere derived from methanol, nitrogen and natural gas.

The base gas forming components sent to the furnace may range from about 0% nitrogen, about 50% ethanol and about 50% water up to about 85% nitrogen, 7.5% ethanol and 7.5% water. The preferred maximum quantity of nitrogen in the feed gas is about 80% with the remainder being about 10% ethanol and about 10% water. Higher nitrogen content may result in unsatisfactory low rates of carburization. The minimum nitrogen content depends upon the particular application. In some circumstances, a base gas derived entirely from ethanol and water may prove advantageous at the beginning of a carburizing run by providing a maximum and uniform rate of carbon transfer. However, such atmospheres are expensive and it is desirable to begin dilution with nitrogen when the high carbon transfer rate can no longer be maintained.

The ratio of ethanol to water is preferably about 1 to 1, although higher ratios may be employed to achieve somewhat higher carbon potentials. Ratios significantly below 1 to 1 should be avoided since they may lead to decarburization and/or oxidation of the steel. The ratio of enriching gas to ethanol may vary from 0 up to a value which produces the desired carbon potential in the furnace. A precise general statement for this upper limit cannot be given since it depends upon many factors including not only the desired carbon potential, but also the furnace temperature, rate of gas circulation, and surface area of the parts being carburized. The values given in Example III are typical of what may be experienced when propane is used as an enriching gas. It is obvious that larger quantities of substances containing less carbon per molecule than propane will be required. The temperature may range from about 1500 to about 1900° F. (816 to about 1038° C.).

The water and ethanol may be introduced separately or in a combined stream either as liquids or vapors. In general, the most simple operation will result when the liquids are thoroughly mixed and then pumped and metered into the furnace as liquids through a spray nozzle or other suitable device which insures rapid and complete vaporization and dispersion of vapors throughout the furnace.

STATEMENT OF INDUSTRIAL APPLICATION

Processes according to the present invention can be used in place of existing gas carburizing processes in batch type furnaces and with proper furnace control in continuous furnaces. Existing furnaces can be readily adapted to the process of the present invention without the need to modifying existing carbon potential measuring equipment.

Having thus described our invention what is desired to be secured by Letters Patent of the United States is set out in the appended claims.

We claim:

1. In a method of carburizing ferrous metal articles utilizing a mixture of nitrogen and ethanol injected into a furnace containing the articles to be carburized maintained at a temperature in excess of 1500° F. (816° C.) the improvement comprising:

adjusting the total input mixture by the addition of 0.31 liters of water to every liter of anhydrous (100%) ethanol, or 0.265 liters of water to every liter of commerical (95%) ethanol, to effect an input mixture of nitrogen, ethanol and water; and controlling the carbon potential of said furnace atmosphere by adding a gas carburizing agent selected from the group consisting of natural gas containing substantially methane, propane, butane, ethane and mixtures thereof in an amount effective to achieve the desired furnace potential as determined by the furnace dimensions and geometry, furnace loading, composition of the articles being carburized, measured furnace temperature, case depth desired, composition of the gas carburizing agent and analysis of the furnace atmosphere during the carburizing cycle.

2. A method according to claim 1 wherein said furnace temperature is between 1550° F. (843° C.) and 1900° F. (1038° C.).

3. A method according to claim 1 wherein said input mixture consists essentially of by volume from 7.5 to 50% ethanol, 7.5 to 50% water balance nitrogen to a maximum of 85%.

4. A method according to claim 3 wherein said input mixture consists essentially of by volume 10% ethanol, 10% water balance nitrogen and carburizing gas.

5. A method according to claim 1 wherein said carburizing gas is selected from the group consisting of natural gas containing substantially methane, propane, butane, ethane and mixtures thereof.

6. A method according to claim 1 wherein gaseous ammonia is added to the gas mixture which effects the deposition of nitrogen on the parts in addition to carbon.

* * * * *